US005758991A

United States Patent [19]

Shiosaka

[11] Patent Number: 5,758,991

[45] Date of Patent: Jun. 2, 1998

[54] UNDERGROUND DAM

[75] Inventor: Kunio Shiosaka, Shizuoka, Japan

[73] Assignees: Environmental Assessment Center Co., Ltd; Okada Company Ltd., both of Shizuoka, Japan

[21] Appl. No.: 694,752

[22] Filed: Aug. 9, 1996

[30] Foreign Application Priority Data

Nov. 17, 1995 [JP] Japan ..... 7-300103

[51] Int. Cl.[6] ..... E02D 5/20; E02D 29/00

[52] U.S. Cl. ..... 405/267; 137/625.31; 405/50; 405/87; 405/107

[58] Field of Search ..... 405/267, 107, 405/108, 87–89, 114, 43, 45, 50, 128; 137/625.31, 625.32, 363; 251/309; 52/169.5, 169.14

[56] References Cited

U.S. PATENT DOCUMENTS

| | | | |
|---|---|---|---|
| 2,929,336 | 3/1960 | Bozoyan | 137/625.32 X |
| 3,268,192 | 8/1966 | Colle | 405/267 X |
| 3,282,248 | 11/1966 | Mann et al. | 137/625.32 X |
| 3,372,549 | 3/1968 | French | 405/92 |
| 4,464,081 | 8/1984 | Hillier et al. | 405/128 X |
| 4,671,705 | 6/1987 | Nussbaumer et al. | 405/267 |
| 4,741,644 | 5/1988 | Cavalli et al. | 405/267 X |
| 4,797,027 | 1/1989 | Combes et al. | 405/92 |
| 4,946,312 | 8/1990 | Loock et al. | 405/129 |
| 5,022,786 | 6/1991 | Philo | 405/129 X |
| 5,077,945 | 1/1992 | Koeniger | 405/114 X |
| 5,388,931 | 2/1995 | Carlson | 405/129 X |
| 5,570,974 | 11/1996 | Jax et al. | 405/128 X |

FOREIGN PATENT DOCUMENTS

| | | | |
|---|---|---|---|
| 0228851 | 4/1991 | Germany | 405/97 |
| 56-44976 | 10/1981 | Japan . | |
| 7-30532 | 4/1995 | Japan . | |

*Primary Examiner*—Dennis L. Taylor
*Attorney, Agent, or Firm*—Kanesaka & Takeuchi

[57] ABSTRACT

An underground dam is formed of a water flow preventing wall for blocking a water permeable layer of soil to form a storing portion for storing underground water on an upper stream side relative to the water flow preventing wall. The water flow preventing wall has an opening, and an opening-closing device for opening and closing the opening is provided. Thus, the underground water on the upper stream side can be supplied to a down stream side through the opening.

8 Claims, 9 Drawing Sheets

UNDERGROUND DAM

BACKGROUND OF THE INVENTION AND RELATED ART STATEMENT

The present invention relates to an underground dam, more particularly, an underground dam such that a water level or water quantity of underground water on a down stream side in the underground water flow is prevented from being lowered or decreased.

As one of methods for highly utilizing underground water, an attention has been made to an underground dam. The underground dam is formed of a water flow preventing wall for blocking or partitioning a natural or artificial water permeable layer of soil in a vertical direction to thereby form a storing portion for storing underground water on an upper stream side of the underground water flow relative to the water flow preventing wall. The underground dam has advantages such that a ground portion thereof can be utilized for other purposes; a construction site of the underground dam is not limited by a condition on the ground level; and water stored in the underground dam does not evaporate.

In a conventional underground dam, a water flow preventing wall is formed by boring a hole in the ground and injecting cement milk thereinto under a high pressure; disposing steel sheets into the ground continuously; or making a trench into the ground and applying concrete therein to thereby form a continuous wall (for example, Japanese Patent Publication (KOKOKU) No. 56-44976 and Japanese Patent Publication (KOKAI) No. 7-30532).

In the above described conventional underground dam, since the water flow preventing wall is simply formed continuously, underground water on an upper stream side of the underground water relative to the water flow preventing wall is only supplied to a down stream side of the wall for an amount flowing over an upper edge of the water flow preventing wall. Thus, there may be disadvantages that a water level or an amount of the underground water on the down stream side may be lowered or decreased.

Therefore, heretofore, construction of the underground dam has been limited to a place where underground water is not used so much in a down stream region, such as a peninsula, remote island or the like.

Accordingly, one object of the present invention is to provide an underground dam, wherein a water level or amount of underground water on a down stream side of an underground water flow relative to the underground dam is prevented from being lowered or decreased, so that the underground dam can be constructed in any places without considering the water flow under the ground.

Another object of the invention is to provide an underground dam as stated above wherein, the water level on the down stream side can be easily controlled.

Further objects and advantages of the invention will be apparent from the following description of the invention.

SUMMARY OF THE INVENTION

In order to attain the above object, a first aspect of the present invention is to provide an underground dam formed of a water flow preventing wall for blocking or partitioning a water permeable layer of soil to thereby form a storing portion for storing underground water on an upper stream side of an underground water flow relative to the water flow preventing wall, wherein the water flow preventing wall is provided with an opening, and an opening-closing device for opening and closing the opening is provided.

A second aspect of the present invention is to provide an underground dam formed of a water flow preventing wall for blocking or partitioning a water permeable layer of soil to thereby form a storing portion for storing underground water on an upper stream side of an underground water flow relative to the water flow preventing wall, wherein the water flow preventing wall is provided with an opening; and there are provided an opening-closing device for opening and closing the opening, and an upper stream side water level detecting device for detecting a water level of underground water on the upper stream side relative to the water flow preventing wall.

A third aspect of the present invention is to provide an underground dam formed of a water flow preventing wall for blocking or partitioning a water permeable layer of soil to thereby form a storing portion for storing underground water on an upper stream side of an underground water flow relative to the water flow preventing wall, wherein the water flow preventing wall is provided with an opening; and there are provided an opening-closing device for opening and closing the opening, an upper stream side water level detecting device for detecting a water level of underground water on the upper stream side relative to the water flow preventing wall, and a down stream side water level detecting device for detecting a water level of underground water on a down stream side relative to the water flow preventing wall.

DETAILED DESCRIPTION OF PREFERRED EMBODIMENTS

Figure 1:
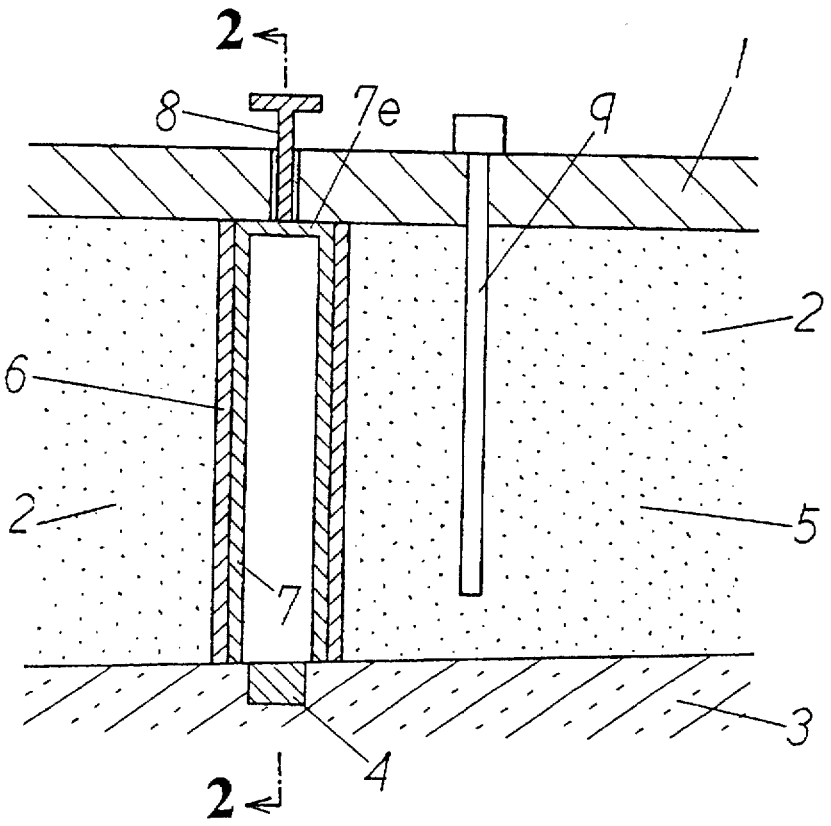
FIG. 1 is a vertically sectional view of an underground dam of an embodiment according to the present invention.
Figure 2:
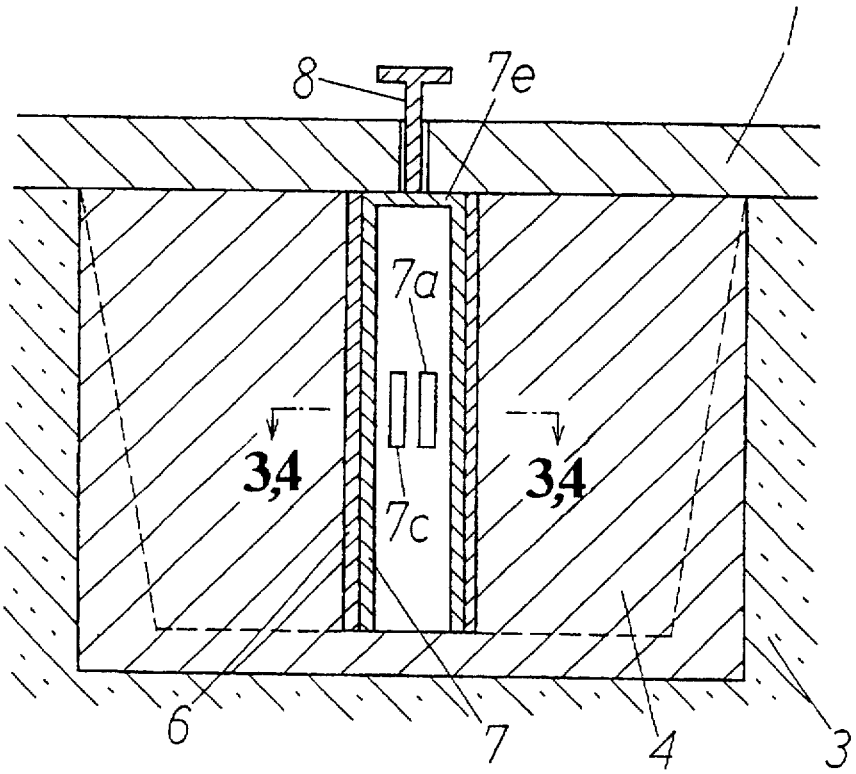
FIG. 2 is a sectional view taken along line 2—2 in FIG. 1.

Hereinunder, embodiments of the present invention are described in detail based on the drawings. In FIGS. 1 to 4, reference numeral 1 represents, for example, a surface layer formed of a water permeable layer or a less water permeable layer; 2 represents a water permeable layer formed of a gravel layer and the like located under the surface layer 1; and 3 represents a water impermeable layer formed of a rock bed, a clay layer and the like.

Reference numeral 4 is a water flow preventing wall made of concrete and extending from a bottom portion of the surface layer 1 to partially encroach the water impermeable layer 3, so that the water flow preventing wall 4 blocks or partitions the water permeable layer 2 in a vertical direction. A storing portion 5 for storing underground water flowing in the water permeable layer 2 is formed on an upper stream side of an underground water flow relative to the water flow preventing wall 4.

Figure 3:
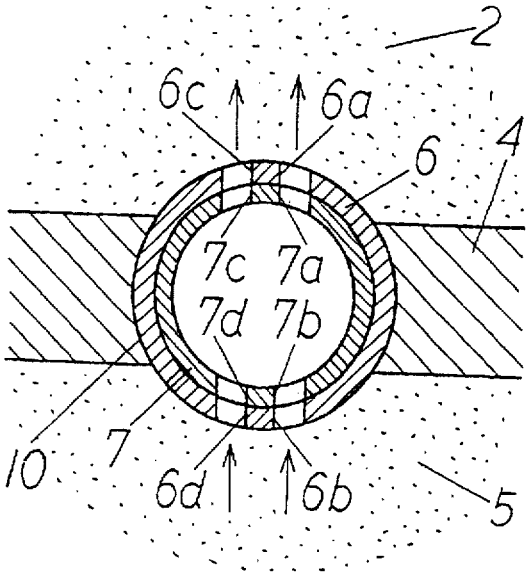
FIG. 3 is a sectional view taken along line 3—3 in FIG. 2, showing an open state of an opening-closing device.
Figure 4:
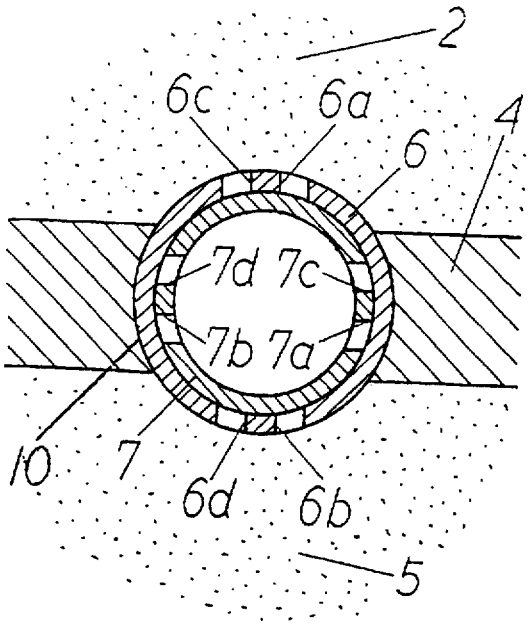
FIG. 4 is a sectional view taken along line 4—4 in FIG. 2, showing a closed state of the opening-closing device.

The water flow preventing wall 4 is provided with an opening 10, which is opened or closed by an opening-closing device. The opening-closing device is, for example, formed of a cylindrical hollow member 6 disposed in the opening 10 formed in the water flow preventing wall 4, and a cylindrical inner member 7 rotatably situated inside the cylindrical hollow member 6 and having an outer diameter approximately equal to an inner diameter of the hollow member 6. More specifically, at an approximately middle portion in a height direction of the hollow member 6 and on a circumferential surface thereof facing the water permeable layer 2 on the upper and down stream sides of the water flow preventing wall 4, as shown in FIGS. 3 and 4, slit shape openings 6*a*, 6*b* and 6*c*, 6*d* are formed to face each other.

The inner member 7 is also provided with openings 7*a*, 7*b* and 7*c*, 7*d* to correspond to the openings 6*a*, 6*b* and 6*c*, 6*d* of the hollow member 6.

Further, a disc portion 7*e* is provided at an upper portion of the inner member 7, and an operating member 8 for rotating the inner member 7 extends from the disk portion 7*e* toward a ground portion through the surface layer 1.

Numeral 9 is a water-intake device for taking out water stored in the storing portion 5 to an outside, which is formed of a water-intake well extending from the surface layer 1 to the water permeable layer 2, wherein the underground water stored in the storing portion 5 can be taken out through a water supply device, not shown.

In the embodiment as described hereinabove, the operating member 8 is operated by driving means, such as human power, a motor (not shown) or the like, to rotate the inner member 7 so that, as shown in FIG. 3, the respective openings 7*a*, 7*b* and 7*c*, 7*d* of the inner member 7 coincide with the respective openings 6*a*, 6*b* and 6*c*, 6*d* of the hollow member 6. Namely, when the inner member 7 is operated to open the openings of the hollow member 6, water in the storing portion 5 flows in from the openings 6*b*, 6*d* of the hollow member 6 through the respective openings of the inner member 7, and flows out from the openings 6*a*, 6*c* of the hollow member 6 through the respective openings of the inner member 7 to the down stream side of the water flow preventing wall 4, as shown by arrows.

Also, from the state, as shown in FIG. 4, in case the inner member 7 is rotated by 90 degrees in a clockwise direction so that the respective openings 7*a*, 7*b* and 7*c*, 7*d* of the inner member 7 do not coincide with the respective openings 6*a*, 6*b* and 6*c*, 6*d* of the hollow member 6, in other word, when the inner member 7 is operated to close the openings of the hollow member 6, water stored in the storing portion 5 is prevented from flowing out.

Accordingly, through an opening-closing operation of the inner member 7, a flowing-out quantity of the underground water toward the down stream side of the water flow preventing wall 4 can be controlled.

Specifically, in the present embodiment, the opening of the water flow preventing wall 4 can be easily controlled by simply rotating the inner member 7. Also, by selecting positions and sizes of the openings of the inner member 7, a minimum storing quantity in the storing portion 5 and a flowing-out quantity per unit hour can be easily set.

Incidentally, in the present embodiment, while the inner member was formed of a hollow cylinder, the inner member may be formed of a solid cylindrical member. In this case, the openings of the inner member may be formed to penetrate through the solid cylindrical member. Also, the respective openings of the hollow member may be covered with filter members, such as a wire net, so that pebbles and the like can be prevented from flowing therein. Further, an upper portion of the water flow preventing wall may be extended above the ground portion.

Next, another embodiment of the present invention is described with reference to FIGS. 5 to 8. A water flow preventing wall 4 is provided with an opening 10 which opens toward an upper stream side and a down stream side and includes inner wall surfaces curved in circular arc, respectively. The opening 10 extends in a vertical direction. In the opening 10, an opening-closing device for opening and closing the opening 10, for example, a bag member 11 made of an expandable rubber or the like, is provided in a vertical direction of the opening 10.

When the bag member 11 is in a free state where pressure is not applied to an inner portion thereof, the bag member 11 shrinks, so that a space X is formed between the inner wall surfaces and the bag member 11. Also, a fluid supply device 12 is connected to an upper portion of the bag member 11.

The fluid supply device 12 is formed of an air compressor 13 and a fluid supply pipe 15 for connecting the air compressor 13 and the bag member 11 through a first closing valve 14. Further, a fluid discharging pipe 17 having a closing valve 16 is connected to the fluid pipe 15.

Figure 5:
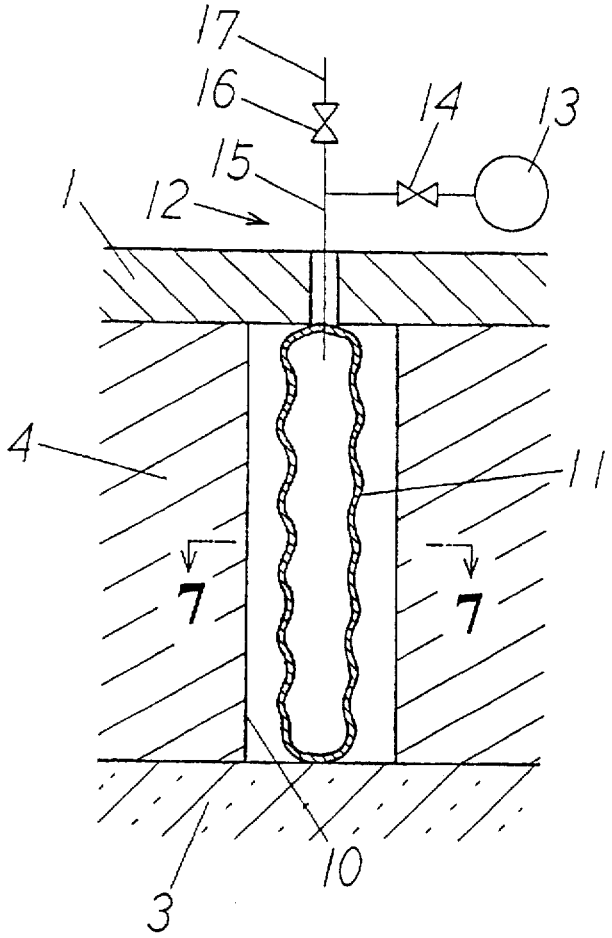
FIG. 5 is a sectional view of an essential part of an underground dam of another embodiment according to the present invention, showing an open state of an opening-closing device.
Figure 7:
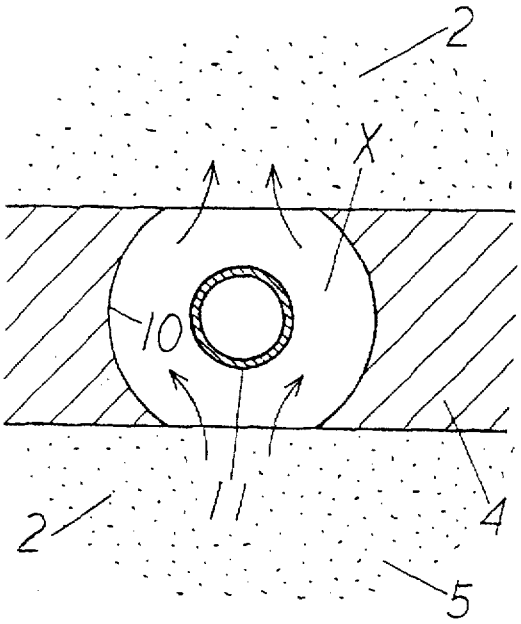
FIG. 7 is a sectional view taken along line 7—7 in FIG. 5.

In the embodiment as described above, in the state where pressure is not applied to the inner portion of the bag member 11, as shown in FIGS. 5 and 7, the bag member 11 shrinks, so that water stored in a storing portion 5 flows out to the down stream side relative to the water flow preventing wall 4 through the space X between an outer circumferential surface of the bag member 11 and the inner wall surfaces of the opening 10 as shown by arrows.

Figure 6:
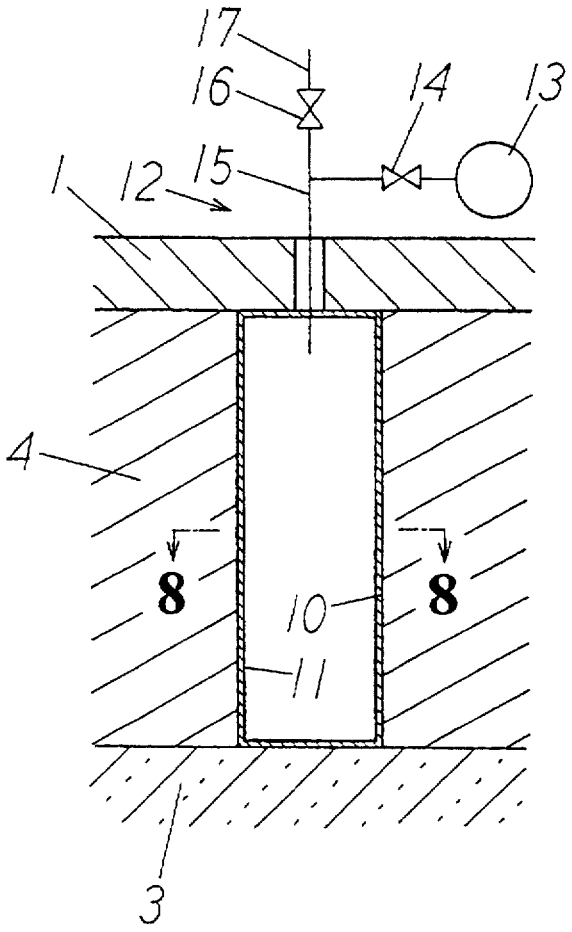
FIG. 6 is a sectional view corresponding to FIG. 5, showing a closed state of the opening-closing device.
Figure 8:
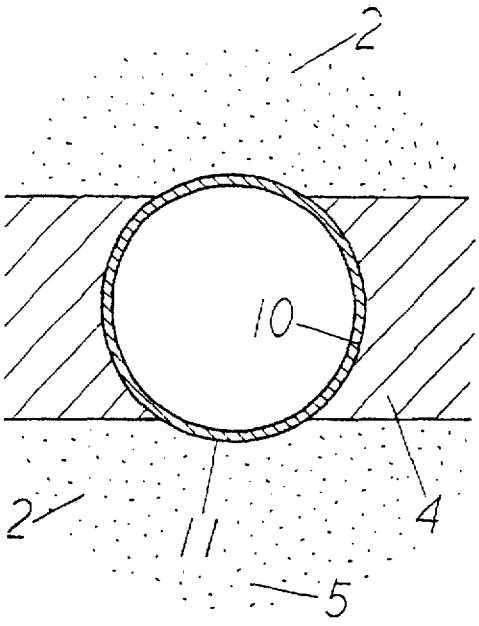
FIG. 8 is a sectional view taken along line 8—8 in FIG. 6.

Next, when the air compressor 13 is operated in a state where the first closing valve 14 is opened and the second closing valve 16 is closed, compressed air is supplied into an interior of the bag member 11 through the liquid supply pipe 15 to gradually expand the bag member 11. Then, as shown in FIGS. 6 and 8, the first closing valve 14 is closed and the air compressor 13 is stopped in a state where an outer circumferential surface of the bag member 11 closely contacts the inner wall surfaces of the opening 10. As a result, the bag member 11 maintains a close contact state with the inner wall surfaces to thereby prevent flowing out of water from the storing portion 5. Further, from this state, in case the second closing valve 16 is opened, the compressed air in the bag member 11 is discharged to the outside through a fluid discharging pipe 17, so that the bag member 11 gradually shrinks to become a state as shown in FIGS. 5 and 7.

Accordingly, through an opening-closing operation of the bag member 11 as an opening-closing device, an amount of underground water flowing out to the down stream side of the water flow preventing wall 4 can be controlled. Also, in the present embodiment, by simply operating the bag member 11 through the fluid supply device 12, the opening 10 of the water flow preventing wall 4 can be easily closed or opened.

Incidentally, in the present embodiment, while compressed air is supplied to the bag member 11, gas other than the compressed air may be supplied. Also, a liquid, such as a water, oil or the like, may be supplied by using a liquid pump.

Figure 9:
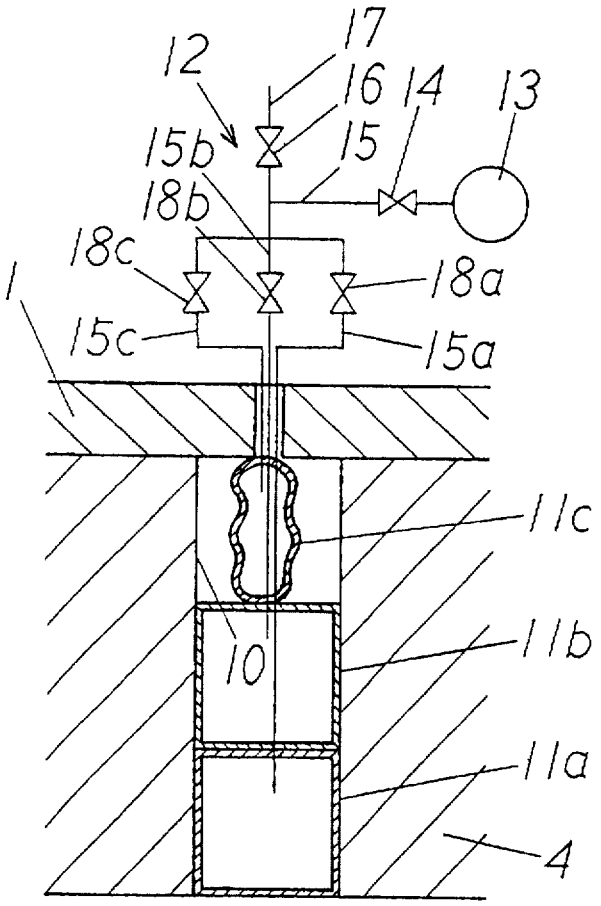
FIG. 9 is a sectional view of an essential part of an underground dam of still another embodiment according to the present invention.

Further, as shown in FIG. 9, an opening 10 of a water flow preventing wall 4 may be closed or opened by using a plurality of bag members.

More specifically, in FIG. 9, three bag members 11*a*, 11*b*, 11*c* are piled in a vertical direction. A first connecting pipe 15*a* branching off the fluid supply pipe 15 is connected to the bag member 11*a* through a third closing valve 18*a*; a second connecting pipe 15*b* is connected to the bag member 11*b* through a fourth closing valve 18*b*; and a third connecting pipe 15*c* is connected to the bag member 11*c* through a fifth closing valve 18*c*. The respective bag members 11*a*, 11*b*, 11*c* are controlled separately.

With the structure as described above, by controlling the number and positions of the bag members for supplying fluid through a fluid supply device 12, an amount of the underground water flowing out to the down stream side relative to the water flow preventing wall 4 can be easily controlled.

Figure 10:
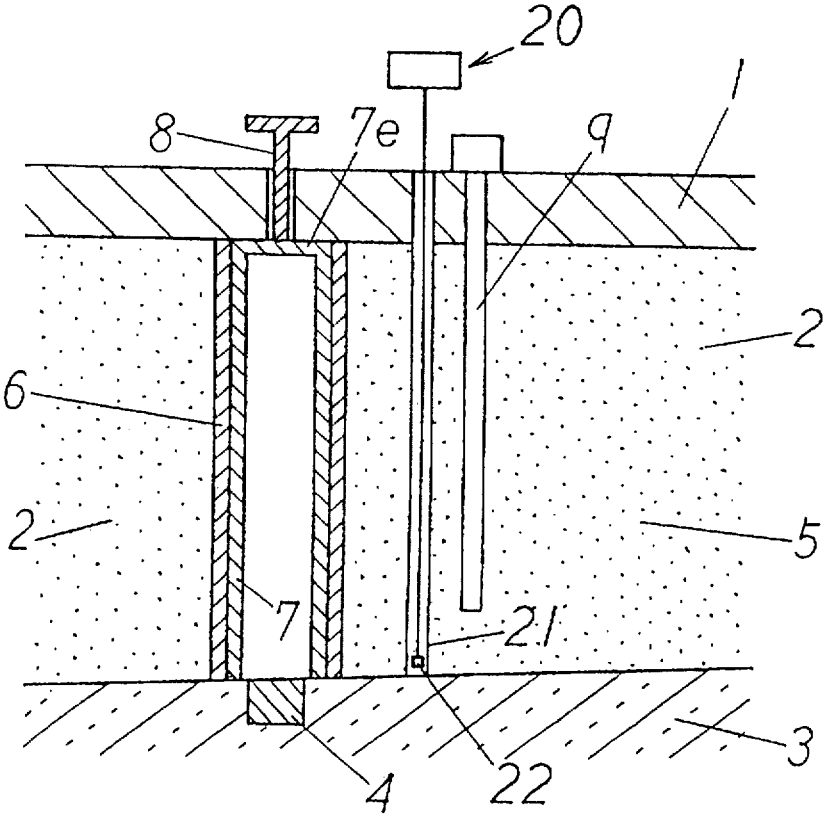
FIG. 10 is a sectional view of an underground dam of a further embodiment according to the present invention.

Next, a further embodiment of the present invention is explained with reference to FIG. 10.

In the embodiments as described hereinbefore, it is difficult to measure an amount of water stored in the storing portion 5, so that a control for opening or closing the opening 10 can not be carried out appropriately.

Accordingly, in the present embodiment, an upper stream side water level detecting device 20 for detecting a water level of underground water on an upper stream side relative to the water flow preventing wall 4 is provided. In case the water level detected by the upper stream side water level detecting device 20 is high, the opening 10 is opened by the opening-closing device, i.e. the hollow member 6 and the inner member 7, described in the former embodiment, and in case the water level detected by the upper stream side water level detecting device 20 is low, the opening 10 is closed by the closing device to thereby hold an appropriate amount of water in the storing portion 5.

As the upper stream side water level detecting device 20, for example, a water level observation well 21 is formed, and a water level sensor 22 is provided in the water level observation well 21. A water pressure detected by the water level sensor 22 is changed into an electric signal to thereby detect a water level of underground water on the upper stream side of the water flow preventing wall 4.

A water level sensor 22 of a float type, for example, besides the hydraulic pressure type, can also be used in the same manner.

Also, in the former embodiment, although the upper stream side water level detecting device 20 is provided on the upper stream side relative to the water flow preventing wall 4, when a water level on the down stream side is extremely lowered, it is impossible to quickly supply water to the down stream side irrespective of the water level of the underground water on the upper stream side.

Figure 11:
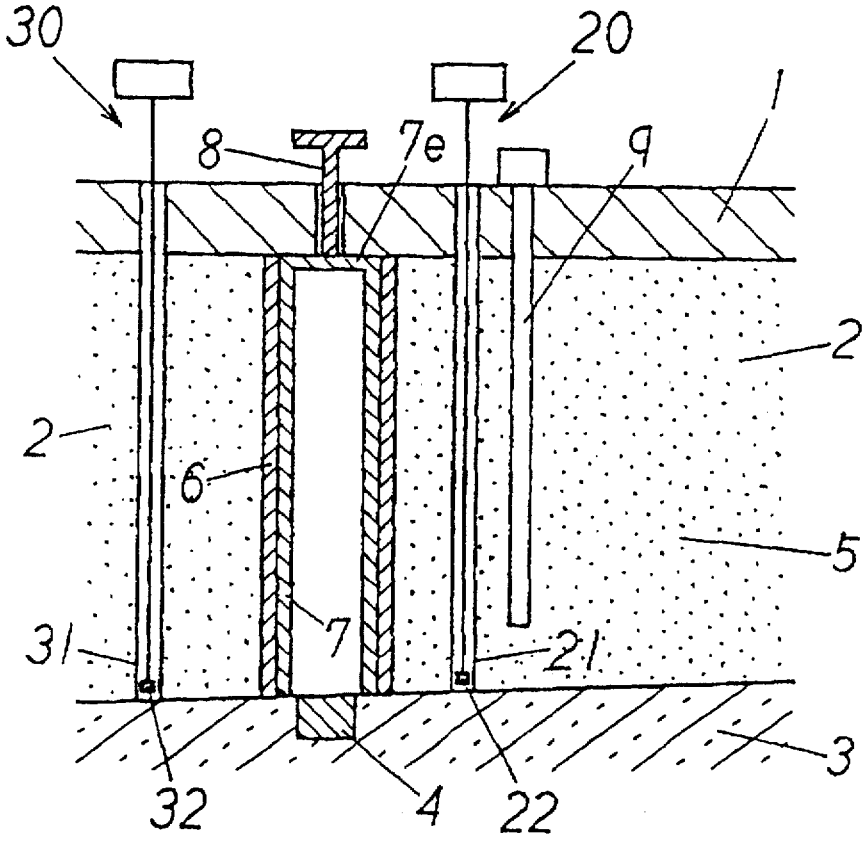
FIG. 11 is a sectional view of an underground dam of a still further embodiment according to the present invention.

In order to cope with such a situation, an underground dam, as shown in FIG. 11, includes an upper stream side water level detecting device 20 provided on an upper stream side relative to a water flow preventing wall 4, and a down stream side water level detecting device 30 provided on a down stream side relative to the water flow preventing wall 4. In case a water level detected by the upper stream side water level detecting device 20 is high, the opening 10 is opened by the opening-closing device, i.e. the hollow member 6 and the inner member 7 as described in the former embodiment, and in case the water level detected by the upper stream side water level detecting device 20 is low, the opening 10 is closed by the opening-closing device. Further, in case a water level on the down stream side becomes extremely low, the opening 10 is opened by the opening-closing device irrespective of the water level of the underground water on the upper stream side to thereby supply water to the down stream side.

Incidentally, as the down stream side water detecting device 30, for example, a water level observation well 31 is formed, and a water level sensor 32 is provided in the water level observation well 31. A water pressure detected by the water level sensor 32 is changed into an electric signal to thereby detect the water level of the underground water on the down stream side relative to the water flow preventing wall 4.

A water level sensor 32 of a float type, for example, besides the hydraulic pressure type, can be used in the same manner.

The present invention is to provide an underground dam formed of a water flow preventing wall for blocking or partitioning a water permeable layer of soil to form a storing portion for storing underground water on an upper stream side of underground water flow relative to the water flow preventing wall. The water flow preventing wall is provided with an opening, and an opening-closing device for opening and closing the opening is formed. Thus, by controlling the opening-closing device, a flowing-out quantity of the underground water to a down stream side relative to the water flow preventing wall can be controlled to thereby prevent a water level of the underground water on the down stream side from being lowered.

Accordingly, a construction site where the underground dam is constructed is not limited, and the underground dam can also be constructed on any places to thereby provide great effects.

Also, in the present invention, an upper stream side water level detecting device may be installed for detecting a water level of underground water on the upper stream side relative to the water flow preventing wall. Thus, by controlling the opening-closing device, a flowing-out quantity of the underground water toward a down stream side relative to the water flow preventing wall can be controlled to thereby prevent an underground water level on the down stream side from being lowered.

Since a water quantity stored in the upper stream side can be detected by the upper stream side water level detecting device, the opening of the water flow preventing wall can be appropriately controlled by the opening-closing device.

Further, in the present invention, a down stream side water level detecting device may be additionally installed for detecting a water level of underground water on a down stream side relative to the water flow preventing wall. Thus, by controlling the opening-closing device, a flowing-out quantity of the underground water to the down stream side relative to the water flow preventing wall can be controlled to thereby prevent a water level of the underground water on the down stream side from being lowered.

In this embodiment, in case the water level on the down stream side is extremely lowered, the opening is opened by the opening-closing device irrespective of the water level of the underground water on the upper stream side. Thus, water can be quickly supplied to the down stream side.

While the invention has been explained with reference to the specific embodiments of the invention, the explanation is illustrative and the invention is limited only by the appended claims.

What is claimed is:

1. An underground dam comprising:

a water flow preventing wall situated in a water permeable layer of soil for blocking the water permeable layer to thereby form a storing portion for underground water at an upper stream side of an underground water flow relative to the water flow preventing wall, said water flow preventing wall having a vertically extending elongated opening; and an opening-closing device including a hollow member situated in said elongated opening and fixed to the water flow preventing wall, said hollow member having first slits on the upstream side and a downstream side of the underground water flow, an inner member situated inside the hollow member to be rotatable about a longitudinal axis of the hollow member and having second slits corresponding to the first slits, and an operating member connected to the inner member for rotating the same, said underground water stored on the upper stream side being supplied to the downstream side relative to the water flow preventing wall through said first and second slits when the first and second slits are aligned by actuating the operating member.

2. An underground dam according to claim 1, further comprising an upper stream side water level detecting device situated near the water flow preventing wall at the upper stream side to detect water level at the upper stream side.

3. An underground dam according to claim 2, further comprising a down stream side water level detecting device situated at the downstream side of the underground water flow to detect water level at the down stream side.

4. An underground dam according to claim 3, wherein each of said upper and down stream side water level detecting devices includes a water level observation well and a water level sensor situated in the well.

5. An underground dam according to claim 1, wherein said hollow member and the inner member have cylindrical shapes so that the inner member is completely retained inside the hollow member to smoothly rotate inside the hollow member.

6. An underground dam comprising:

a water flow preventing wall situated in a water permeable layer of soil for blocking the water permeable layer to thereby form a storing portion for underground water at an upper stream side of an underground water flow relative to the water flow preventing wall, said water flow preventing wall having a vertically extending elongated opening; and an opening-closing device including at least one bag member situated in said elongated opening and fixed to a part of the water flow preventing wall, and a fluid supply device attached to the at least one bag member so that when fluid is fully supplied to the bag member by the fluid supply device, the bag member expands inside the elongated opening to prevent the underground water from flowing through the opening, and when the bag member is not expanded inside the elongated opening, water passes through the elongated opening.

7. An underground dam according to claim 6, wherein a plurality of bag members is situated in the opening to be opened and closed independently.

8. An underground dam according to claim 7, wherein said plurality of bag members are laminated vertically to adjust an amount of water flowing through the elongated opening.

* * * * *